US007080831B2

(12) United States Patent
Sasamoto et al.

(10) Patent No.: US 7,080,831 B2
(45) Date of Patent: Jul. 25, 2006

(54) SHEET-SORTING APPARATUS

(75) Inventors: Shinya Sasamoto, Fujii-chou Kitagejou (JP); Takashi Saito, Mitsukunugi (JP); Yoshihisa Ogasawara, Oosato-chou (JP); Keiichi Nagasawa, Doudou (JP); Shigeyuki Sanmiya, Shimizuarai (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/600,455

(22) Filed: Jun. 23, 2003

(65) Prior Publication Data

US 2004/0089998 A1 May 13, 2004

Related U.S. Application Data

(62) Division of application No. 09/839,662, filed on Apr. 23, 2001, now Pat. No. 6,619,648.

(30) Foreign Application Priority Data

Apr. 21, 2000 (JP) ..... 2000-120503

(51) Int. Cl.
*B65H 5/22* (2006.01)

(52) U.S. Cl. ..... 271/3.03; 271/248; 271/250; 271/253; 271/302; 271/306

(58) Field of Classification Search ..... 271/3.02–3.03, 271/246, 250, 253, 302, 306, 902; 270/58.12, 270/58.16, 58.17
See application file for complete search history.

(56) References Cited

U.S. PATENT DOCUMENTS

| | | | | |
|---|---|---|---|---|
| 5,021,837 | A * | 6/1991 | Uto et al. | 399/405 |
| 5,137,265 | A * | 8/1992 | Sato et al. | 270/58.12 |
| 5,288,062 | A * | 2/1994 | Rizzolo et al. | 270/58.12 |
| 6,179,287 | B1 * | 1/2001 | Watanabe et al. | 271/215 |
| 6,241,234 | B1 * | 6/2001 | Saitoh et al. | 270/58.12 |
| 6,290,220 | B1 * | 9/2001 | Takehara et al. | 270/58.12 |

* cited by examiner

*Primary Examiner*—Gene O. Crawford
*Assistant Examiner*—Mark A. Deuble
(74) *Attorney, Agent, or Firm*—James Creighton Wray

(57) ABSTRACT

A sheet-sorting apparatus has a stacking tray to stack sheets formed with indicia thereupon, a processing tray to receive said sheets in the process leading to said stacking tray, and when necessary, a path to discharge directly to said stacking tray and a path to discharge said sheets to said stacking tray means via said processing tray means the paths being selectable, enabling a leading set of a plurality of sheets to be discharged directly the stacking tray and continuing to stack subsequent sheet sets in said processing tray through which process leading set of sheets and the subsequent set of sheets are sorted on the stacking tray.

5 Claims, 5 Drawing Sheets

SHEET-SORTING APPARATUS

This application is a division of application Ser. No. 09/839,662 filed Apr. 23, 2001 now U.S. Pat. No. 6,619,648.

BACKGROUND OF THE INVENTION

1. Field of the Invention

This invention relates to a sheet-sorting apparatus for sorting sheets discharged from a copy machine, printer or an image-processing device.

2. Description of the Related Arts

The following describes a sheet-sorting apparatus that is used to sort a series of sheets formed with indicia thereupon into pluralities of sets.

Sheet-sorting apparatuses have a stacking tray for the final stacking of sheets having indicia formed thereupon and a processing tray established along the path of a process to transport sheets to the stacking tray. Also, sheets that have indicia formed thereupon are stacked on an interim-processing tray from which they can be switched backed and discharged to the stacking tray.

In the transporting process of the sheets just described, all sheets are transported to the interim-processing tray whereat the relative positions of the sets of sheets are shifted. In other words, the interim-processing tray shifts the leading sheet set to either the right side or to the left side for sorting.

In the type of apparatus as described above, all of the sheet sets have to be shifted in order to be sorted, so any subsequent sheet sets cannot be transported to the processing tray without discharging the sheet set that is on the processing tray to the interim-processing tray. Therefore, while discharging the sheet set on the interim-processing tray to the stacking tray, a waiting time had to be created for stopping the transporting of subsequent sheets. Because such waiting time is required, the continuation of the process is interrupted and much processing time is required.

Also, if a series of sheets to be sorted exceeds the limit that can be stacked on the processing tray, the sheet set could not be carried onto the processing tray at one time.

The objective of this invention is to attain a sheet processing apparatus that is capable of continuous processing without requiring waiting time, as has been necessary in the past, and to provide an image-processing apparatus equipped with such an apparatus.

SUMMARY OF THE INVENTION

The first object of the present invention calls for a sheet processing apparatus to have a stacking tray for stacking sheets with indicia formed thereupon, being equipped with a processing tray to receive said sheets in the process leading to this stacking tray a path to discharge said sheets directly to the stacking tray as required, the path for discharging to the stacking tray via processing tray is selectable.

In the first object of the present invention, the apparatus directly discharges a plurality of leading sheets to the stacking tray, then in continuation, stacks subsequent sheet sets onto the processing tray, then via this processing tray, the apparatus discharges completed sheet sets to the stacking tray and changes the relative stacking positions of the leading and of subsequent sheet sets on the stacking tray to sort the leading and subsequent sheet sets.

The second object has a shifting means for shifting while sheets are overlapping the stacking tray and the processing tray, in the process via the processing tray.

The third object of the present invention is to handle as a single set, a plurality of leading sheets discharged directly to the stacking tray and subsequent sheet sets to be discharged as sets to the stacking tray via the processing tray and having a waiting time set for sheet transfer between the leading single body and the subsequent single set.

The fourth object of the present invention is to handle a plurality of leading sheets discharged directly to the stacking tray and subsequent sheet sets to be discharged as sets to the stacking tray via the processing tray as a single set and to continuously discharge the leading single set and subsequent single set in one action to the stacking tray.

The fifth object of the present invention is to handle a plurality of leading sheets discharged directly to the stacking tray and subsequent sheet sets to be discharged as sets to the stacking tray via the processing tray as a single set. Here, the sheet set discharged from the processing tray for the leading set and the sheets discharged directly to the stacking tray for the subsequent set are overlapped and then discharged.

The sixth object of the present invention is a sheet processing apparatus having a stacking tray for stacking image processed sheets, a processing tray for temporarily stacking sheets in the process leading to the stacking tray, a shifting means to change the position of the stacked sheets on the processing tray and a capacity recognition means for recognizing the volume of stacked sheets for stacking on the processing tray, to sort sheets in prescribed numbers of sheets.

In the sheet processing apparatus of the sixth object, when the capacity recognition means recognizes that the amount of sheets stacked on the processing tray has exceeded the stacking limit or the capacity of the processing tray, it discharges those sheets stacked on the processing tray to the stacking tray while continuing the operation of the shifting means so that the relative positions of the sheets previously discharged onto the processing tray and the subsequent sheets of the same set are the same until the prescribed number of sheets of the entire set that is desired has been reached for the subsequent sheets.

The seventh object of the present invention is to temporarily stop the stacking of the subsequent sheets onto the processing tray when the capacity recognition means recognizes that the amount stacked on the sheets on the processing tray has exceeded the stacking limit of the processing tray.

The eighth object of the present invention is a capacity recognition means comprising a counting means for counting the number of sheets to be stacked on the processing tray.

The ninth object of the present invention is a capacity recognition means comprising a level sensor for determining the level of the sheets that have been stacked on the processing tray.

The tenth object of the present invention is an image forming apparatus such as a copy machine or printer and the sorting of the sheets discharged from the image forming apparatus equipped with a sheet finishing apparatus for stapling or opening holes, the sheet finishing apparatus equipped with a stacking tray for stacking sheets formed with indicia thereupon, and a processing tray to receive said sheets in the process leading to said stacking tray, a path to discharge said sheets directly to the stacking tray as required and a path for discharging to the stacking tray via processing tray, both paths being selectable.

The image forming device of this tenth object of the present invention is also provided a control mechanism to sort the leading sheet set and the subsequent sheet set by directly discharging the leading plurality of sheets to the stacking tray, then continuing to stack the subsequent sheet sets on the processing tray, and discharging the set of sheets to the stacking tray via this processing tray to change the relative stacking positions of the leading sheet set and the subsequent sheet set on the stacking tray.

DETAILED DESCRIPTION OF THE PREFERRED EMBODIMENTS

The following is a detailed explanation of the preferred embodiment of the present invention based on the figures provided.

FIG. 1 which shows the embodiment of the instant invention is a sectional view of the sheet finishing apparatus. Sheet finishing apparatus 1 is established adjacent to an image forming apparatus 3 such as a copy machine or printer.

Sheets formed with indicia are transported into such a sheet finishing apparatus 1 via image forming apparatus 3. Sheets transported into the sheet finishing apparatus 1 can be transported through one of either of two systems. One is the path to transport them directly out to the stacking tray 2 and the other is the path to transport sheets to the stacking tray 2 via the processing tray 4.

Also, if the operator selects a sorting mode, the path to directly transport sheets out to the stacking tray and the switch-back path to discharge sheets to the stacking tray passing through the processing tray can be used alternately. In other words, after discharging the leading sheets of the set continuously one at a time to the stacking tray 2, subsequent sheet sets are temporarily stacked on the processing tray 4. The apparatus then switches back and discharges that subsequent set to the stacking tray 2.

Also, all sheets are held in a fixed position to be discharged directly to the stacking tray. The position of the sheets transported to the processing tray 4 is shifted in relation to the position of the set of sheets directly discharged to the stacking tray 2 and in such a state they are discharged to the stacking tray. In other words, by alternating the use of the two systems just described, the sheet sets transported directly to the stacking tray 2 and the sheet sets discharged via the processing tray 4 can be sorted.

Varying from this, if the operator were to select the non-sorting mode, all sheets would be discharged to the stacking tray. Therefore, sheets stacked thereupon would be layered upon each other in the same position.

Next, the configuration of use of sheets being discharged via a direct discharge path, and sheets being discharged via the switch-back path will be explained in further detail.

First, a description of discharging via a direct discharge path is provided.

In FIG. 1, the sheet formed with indicia in the image forming apparatus 3 is transported into the inlet 6 of the sheet finishing apparatus 1. At this inlet 6 the leading edge of the sheet is recognized by a sensor which is not shown in FIG. 1. As the sensor recognizes the sheet, the transfer rollers 7 and 8 rotate to draw the sheet further into the sheet finishing apparatus 1.

When the leading edge of the sheet is recognized by the transport in sensor, just described, rotating member 11 rotates in the direction from the solid lines to the position of the dotted lines to cause the rising and lowering roller 12 established at its leading end to make contact with the drive roller 13 which is capable of both forward and reverse rotations.

When the transfer rollers 7 and 8 draw the sheet further in, the intermediate transport rollers 9 and 10 feed the sheet in the direction of the stacking tray 2. Finally, rising and lowering roller 12 and drive roller 13 which are in contact with each other, grip the sheet to discharge it to the stacking tray 2.

Next, a description of the discharging of the sheet sets via the switch-back path will be provided.

When discharging a set of sheets via the switch-backpath, the rotating member 11 maintains the state shown in FIG. 2. In this drawing, the rising and lowering roller 12 maintains a position, which is separated from drive roller 13.

Therefore, sheets that pass through intermediate transport rollers 9 and 10 are faced toward a portion of stacking tray 2 passing through drive roller 13 while being pushed out by those rollers of 9 and 10. Then, as the trailing edge of the sheets of the direction of its transport leave the intermediate transport rollers 9 and 10, the trailing edge of the sheets fall into the processing tray 4.

As the trailing edge of the sheets fall into the processing tray 4, drive roller 13 reverses its rotation while the paddle drive roller 21, which is fixed to the drive axis 14, rotates. This paddle drive roller 21 is interlocked to the paddle drive roller 22 which is fixed to paddle 23. Therefore, the rotation of the drive axis 14, rotates paddle 23. At this time, the rotating direction of the paddle is counter-clockwise in FIG. 2.

In the way described above, the drive roller 13 reverses its rotation and paddle 23 rotates in the counter-clockwise in FIG. 2 so sheets that are on the drive roller 13 are transported in the direction of the arrow in FIG. 2 which is the processing tray 4. Furthermore, the lower edge of the transport belt 16 which is trained around the intermediate transport roller 10, which has just been described, contacts the sheet in the processing tray 4 to transport it in the direction of the arrow in FIG. 2. The reason is that the intermediate transport roller 10 is rotating counter-clockwise around the center of the rotational axis 10*a*, and the rotation of the transport belt 16 trained on the auxiliary roller 15 also rotates in the counter-clockwise direction in FIG. 2. Furthermore, the transport belt 16 is trained on the intermediate transport roller 10 so as long as the intermediate transport roller 10 is rotating, the transport belt 16 will continue running.

Therefore, sheets fed to the processing tray 4 are fed in the direction of the arrow in FIG. 2 by the transport belt 16 and the leading edge of the sheet in the direction of its transport arrives at the stopper established in processing tray 4.

FIG. 3 shows a perspective view of the part with the processing tray removed. In FIG. 3, a movable conforming plate 17 is established on one side of the processing tray 4, and if fixed conforming plate 30 established in opposition to the movable conforming plate 17. The guide protrusion 17*a* formed on the lower side of said movable conforming plate 17 passes freely through the guide slit 4*a* formed on the process tray 4 and passing edge is fixed to rack member 32. The rack member 32 is movable established below process tray 4 along its with a direction and fits into pinion 33. The opinion 33 rotates by the drive motion of stepping motor 31.

Now, when the stepping motor 31 rotates in the direction of the arrow of FIG. 3, the rack member 32 moves in the left or right directions of the figure correspond to the amount of rotation of the stepping motor 31 If the rack member 32 moves to left direction of the figure, the movable conforming plate 17 moves in accordance.

In this manner, the movable conforming plate 17 is moved to push sheets position between the movable conforming plate 17 and the fixed conforming plate 30, as shown in FIG. 4 to against the fixed conforming plate 30.

In other words, this configuration sets sheets fed to the processing tray 4 in the same relative position of the width direction of the sheets directly discharged to the stacking tray 2. When the relative positions are the same, sheets fed to the processing tray 4 are positioned substantially in the center of the processing tray 4 as indicated by the symbol S1 in FIG. 4. Namely, the left side of the drawing of the sheet is a space between itself and the fixed conforming plate 30.

Sheets substantially centered are shifted toward the direction of the fixed conforming plate 30 by the movable conforming plate 17 by pushing them toward the fixed conforming plate 30 to a position indicated by the symbol of S2 in FIG. 4.

In this way, sheets pushed toward the fixed conforming plate 30 maintain the position shifted in the width direction of the sheets with regard to the sheets directly discharged to the stacking tray 2. Therefore, as shown in FIG. 6, if the sheet sets 4 that is pressed against the fixed conforming plate 30 is discharged in its present positioning to the stacking tray 2, it can be sorted with regard to the sheet set that has already been directly discharged to the stacking tray 2.

Furthermore, the sheet set pressed against the fixed conforming plate 30 is further uniformly arranged against that side by the pressing force of the movable conforming plate 17.

Next, we will use FIG. 5 to explain the sheet set stacked on the processing tray 4 and the mechanism to discharge that set all at once to the stacking tray 2.

FIG. 5 is a sectional view of the main mechanism of the sheet finishing apparatus. The stacking tray 2 is positioned in the location in the front of the direction of the arrow in FIG. 5.

In this apparatus, the entire sheet set stacked on the processing tray 4 is discharged to the stacking tray 2 by being gripped between the rising and lowering roller 12 and the drive roller 13, but the timing for the pressing by the rising and lowering roller 12 against the sheet set is determined by the following.

Namely, when sorting sheets that have been processed with images, the number of sheets that comprise that set is stored in memory in advance. Then, when the shifting operation for that number of sheets in the set is completed, rotating member II rotates in the counter-clockwise in FIG. 2. In this way, when the rotating member 11 rotates in the counter-clockwise direction, the rising and lowering roller 12 presses against the sheets that are on the drive roller 13, as shown in FIG. 5.

In this state, by rotating the drive roller 13, the sheet set stacked in the processing tray 4 are discharged to the stacking tray 2 all at once.

Furthermore, if the sheet set stacked in processing tray 4 is to undergo further processing, such as being stapled or to have holes punched therein, the rising and lowering roller 12 will press against the sheet set when those processes have been completed.

In either case, when all processes that should be completed at the processing tray 4, the rising and lowering roller 12 is made to press against the sheet set as described above.

Additionally, the symbol 19 is a paper-pressing lever in FIG. 1 and this lever is swingingly established below the drive roller 13. Driving the drive mechanism, which is not shown in the drawings, makes the leading edge 19*a* touch the stacking tray 2 or makes it separate from the stacking tray 2. When the leading edge 19*a* touches the stacking tray 2, the leading edge 19*a* of the paper pressing lever 19 pushes the sheet set stacked on the stacking tray 2.

The reasons for pushing the sheet set stacked on the stacking tray 2 by the paper pressing lever 19 are described below. Namely, some of the sheets stacked on the processing tray 4 protrude over the stacking tray 2. Therefore, the protruding portions of the sheets stacked on the processing tray 4 are layered in relation to the sheets that were directly transported to the stacking tray 2, on the stacking tray 2. In this situation, when the sheets stacked on processing tray 4 are shifted, the sheets directly discharged to the stacking tray 2 are also moved. If sheets on the stacking tray 2 are also moved, it would not be possible to distinguish between the sheet set that have already been sorted.

The leading edge 19*a* of the paper pressing lever 19 pushes the sheet set to the stacking tray 2 so that the set does not move and such a situation in which the two sorted sets cannot be distinguished will not occur.

Furthermore, the stapler labeled 43 in FIG. 4 staples the sheet set that has been arranged on the processing tray.

The following will explain the control mechanism that exists in the apparatus described above. As shown in FIG. 8, the rotating member drive circuit 61, the transport-in sensor 62, the paper pressing lever drive circuit 63, the transport motor drive circuit 64 to drive the various transport rollers, the conformity plate drive circuit 65, the paddle drive circuit 66 and the stapler unit 67 are connected in the control mechanism 110. Furthermore, the communications circuit 68 is connected in the control mechanism 110, but the communications circuit 68 is also connected to the control mechanism 110 to which the sensor signals of the image-processing unit 3 are input.

As can be seen in FIG. 9, sheet counters 115 and 116 are established at the image-processing unit 3 to count the number of sheets at the exit of cassettes 113 and 114. The detection signals of the sheet counters 115 and 116 are transmitted to the control mechanism 110 via the communications circuit 68.

The item numbered 118 in the drawing is the drum.

The following will explain the pattern to discharge sheets to the stacking tray using the above-mentioned path as indicated in FIG. 7(A).

For example, if an operator was planning to make six copies of a three-page document, the operator would set the three pages onto the image-processing unit 3 and use the operation panel (not shown) to input to the control mechanism 110 that they need six copies to be produced and then select the sort mode.

Also, when the operator selects the sorting mode, the path to directly transport sheets out to the stacking tray and the switch-back path to discharge sheets to the stacking tray passing through the processing tray 4 would be used alternately. Namely, as can be seen in FIG. 7(A), the 3 sheets for the leading first set of copies would be discharged one at a time to the stacking tray 2. Then, after temporarily stacking the three sheets for the subsequent, second set of copies at the processing tray 4, it would shift them and switch back to discharge the set to the stacking tray 2.

Then, after discharging the set of sheets of the first set of copies to the stacking tray 2, no waiting time is required in the process to transport out the set of the second set copies to the processing tray 4. The reason for this is that while the sheets of the first set of copies are being transported directly to the stacking tray 2, the processing tray 4 is empty so the second set of copies can continue and be transported to the processing tray 4.

However, a waiting time is established to stop the transport of the sheets after discharging the set of sheets of the second set of copies from the processing tray 4, in the process to discharge the sheet set of the third set of copies to the stacking tray 2. Namely, until the second set of copies on the processing tray 4 are discharged to the stacking tray 2, the set of the third set of copies are not discharged to the stacking tray 2. To use a different expression, the sheet set of the first set of copies and the sheet set of the second set of copies are considered another group and are considered the leading batch and if the sheet set of the third set of copies and the sheet set of the fourth set of copies are considered one group and are considered the subsequent batch, a waiting time is established in the process to discharge the leading and the subsequent batches.

Even if the waiting time between the leading and subsequent batches is set, that time can be made shorted than is currently possible. To explain this, currently, a waiting time is established between the first set of copies and the second set of copies and waiting times must be set between each sheet set.

Therefore, in the preferred embodiment, not only is no waiting time required between the first set of copies and the second set of copies, so processing time can be shortened.

The following will explain the discharge pattern as indicated in FIG. 7(B).

The discharge pattern, in the same way as in FIG. 7(A), the operator selects the sorting mode and the path to directly transport sheets out to the stacking tray and the switch-back path to discharge sheets to the stacking tray passing through the processing tray 4 would be used alternately. Namely, as can be seen in FIG. 7(B), the 3 sheets for the leading first set of copies would be discharged one at a time to the stacking tray 2. Then, after temporarily stacking the three sheets for the subsequent, second set of copies at the processing tray 4, it would shift them and switch back to discharge the set to the stacking tray 2.

Then, at the same time as discharging the set of sheets of the second set of copies, at least one page of the third set of copies is discharged directly to the stacking tray 2. Namely, at least one page of the second and third sets of copies are made to overlap and are discharged directly to the stacking tray 2. While continuing this, the third set of copies is directly discharged and the process is completed. Next time, the sheets for the fourth set of copies are fed and at that point they are shifted.

Then, when the sheets of the fourth set of copies are shifted on the processing tray 4, at the same time as discharging that set of sheets to the stacking tray 2, at least one page of the fifth set of copies is discharged directly to the stacking tray 2. While continuing this, the fifth set of copies is directly discharged and the process is completed. Next time, the sheets for the sixth set of copies are fed to the processing tray 4 and at that point they are shifted.

Repeating this process makes a waiting time to stop the transport of sheets unnecessary even with gaps between any set of copies.

The following will explain the discharge pattern as indicated in FIG. 7(C).

In this discharge pattern, for example a large number of documents, say, 50 pages are to be copied and then to be sorted. Here, the meaning of a large number of documents is intended to mean an amount that cannot be held in the processing tray 4 at one time. Therefore, when executing this pattern, it is necessary to teach the limit of the number of pages that can be held in processing tray 4 to the control mechanism 110 in advance. Also, it is necessary to create a capacity recognition means to detect when the limit has been reached.

As a capacity recognition means, it is possible, for example, to use the sheet counters 115 and 116 as indicated in FIG. 9.

Because the control mechanism 110 stores the limit of the number of pages that can be held in processing tray 4, it will stop the transport of sheets that exist in the transport path 117 when the number of sheets counted by the sheet counters 115 and 116 exceed that limit.

Furthermore, as a means for capacity recognition, rather than use a page counter, it is also possible to detect the thickness of the sheets actually stacked on the processing tray 4. In this case, as shown in FIG. 9, thickness detection sensor 112 to detect the thickness of the sheets is established near the processing tray 4.

Also, the control mechanism 110 in this apparatus, as indicated by 110 in FIG. 9, can be established on the sheet processing apparatus side, and as indicated by 111, it is obvious that it can also be established on the image-processing unit 3 side.

Here, we will explain the control mechanism 111 on the image-processing unit 3 side. Information of the sheet-sorting count information (for example, for every 50 pages) is input to the control mechanism 111. This sheet-sorting count information is input by an operator through a sheet-sorting count setting means from a control panel or a personal computer to set the number of sheets to sorted. Furthermore, the number of sheets being drawn out from the cassettes 113 and 114 is input to the control mechanism 111. This sheet-sorting count information is input to the control mechanism 111 from the sheet counter 115 and 116 that is established at the entrance to the image-processing unit 3. The sheet counter 115 and 116 counts the number of sheets that are drawn from the cassettes 113 and 114 into the image-processing unit 3. In addition, the control mechanism 111 is set in advance with the stacking limit capacity (for example, 30 sheets) of processing tray 4.

Therefore, if sheets are being discharged now to the processing tray 4 from the cassette 114, the sheet counter 115 located at the entrance to the image-processing unit 3 counts the number of sheets drawn from the cassette 114. When the value of the counter reaches the stacking limit capacity of processing tray 4 (for example, 30), it temporarily stops the drawing out of sheets from the cassette 114. Along with that, a signal indicating the discharge the sheet set stacked in the processing tray to the stacking tray 2 is output to the control mechanism 110 on the sheet processing apparatus 1 side. Sheet processing apparatus 1 discharges the sheet set to stacking tray 2 according to this signal.

Then, an empty sensor on the processing tray 4, not shown, detects that the sheet set has been discharged from the processing tray 4. At this point, when this signal is sent to the control mechanism 111 on the image-processing unit 3 side, sheets are again drawn from the cassette 114 until the sheet-sorting count information (for example, 50) is reached (for example, the remaining 20 sheets).

Furthermore, the sheet size information of the sheet size detection means, not shown, established on the cassette 114 is relayed to the control mechanism 110 located on the sheet processing unit 1 side via the control mechanism 111 for the shifting amount of the movable conforming plate 17 to shift the sheets on the sheet processing tray 4. This, then, sets the shifting amount of the movable conforming plate 17 according to the sheet size information. Through this, the shifting amount for the sheets first discharged to the stacking tray 2 and the shifting amount for the sheets subsequently discharged are the same positions until the sheet-sorting count information (for example, 50) is reached.

Later, when the sheet-sorting count information (for example, 50) is reached, the subsequent sheet set on the processing tray 4 and the first sheet of the following and continuing sheets to be processed are discharged to the stacking tray 2 along with the sheets discharged directly.

To explain this sorting method using FIG. 7(C), with this pattern, the first set of 50 pages are discharged directly to the stacking tray 2. When all 50 pages of the first set of copies have been completely discharged directly, at that time, the second set of 50 pages are shifted while the number of sheets within the limit of the stacking capacity of the processing tray 4 are being fed to the processing tray 4.

Furthermore, in this embodiment, that stacking limit capacity is 30 pages.

In this way, when the sheets of the stacking limit capacity of the processing tray 4 are fed to the processing tray 4, the sheet counter 115 or 116, just described detect them and transmit that information to the control mechanism 110.

The control mechanism 110 stops the transporting of sheets in the transport path 117 when it detects that the stacking limit of the processing tray has been reached. While the transport of sheets is stopped, the sheet set stacked on the processing tray 4 is discharged. When the 30 pages stacked on the processing tray 4 are discharged as a set, the next 20 pages are fed to the processing tray 4 and at the same time they are shifted. Then, the remaining, shifted 20 pages are discharged to the stacking tray 2.

When these 20 pages are discharged, all 50 pages of the third set of copies are discharged directly to the stacking tray 2. Then, when all 50 pages of the third set of copies have been completely discharged directly, at that time, the fourth set of 50 pages are shifted while the number of sheets within the limit of the stacking capacity of the processing tray 4 are being fed to the processing tray 4. Repeating this operation will sort to the specified number of pages.

In this embodiment, it is also possible to allow the sheets to straddle a stacking tray and a processing tray when shifting on the processing tray in the set discharged mode. In such a case, it is appropriate to establish the shifting means between a stacking tray and a processing tray.

Also, it is possible to create a control mechanism in this apparatus on the sheet processing apparatus as shown in FIG. 9.

Figure 1:
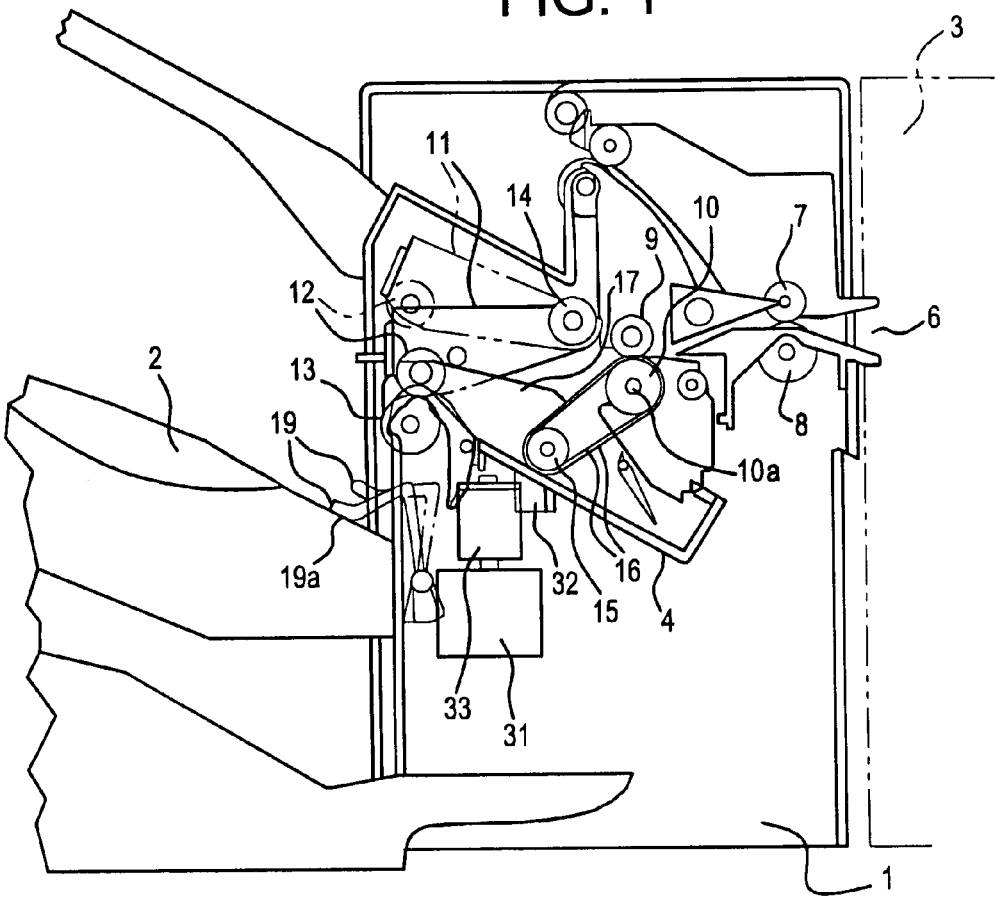
FIG. 1 is a sectional view of the sheet finishing apparatus.
Figure 2:
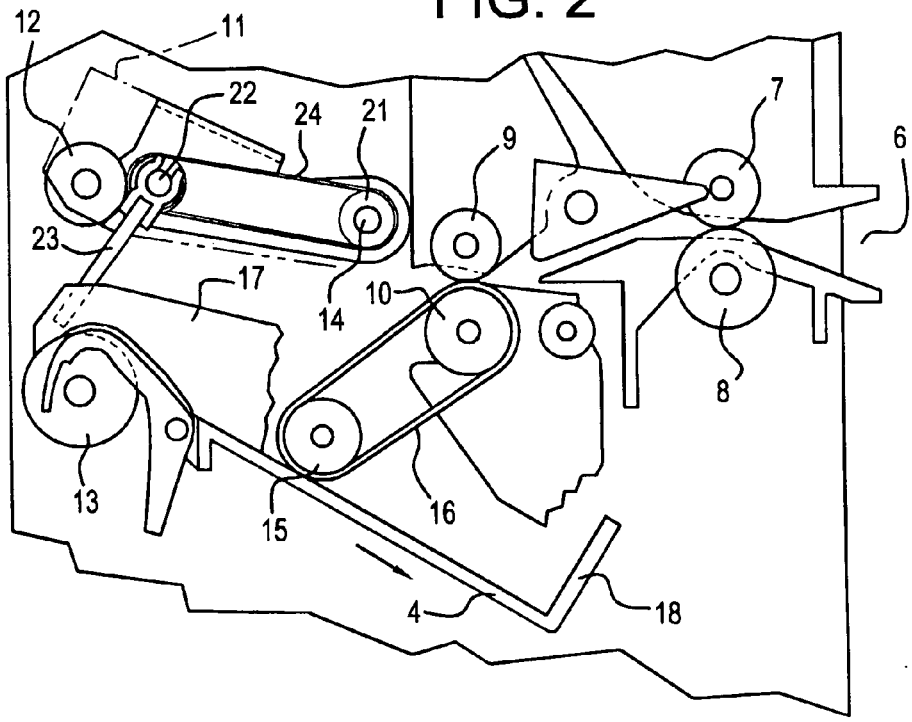
FIG. 2 is a sectional view of the apparatus showing the switch back path.
Figure 3:
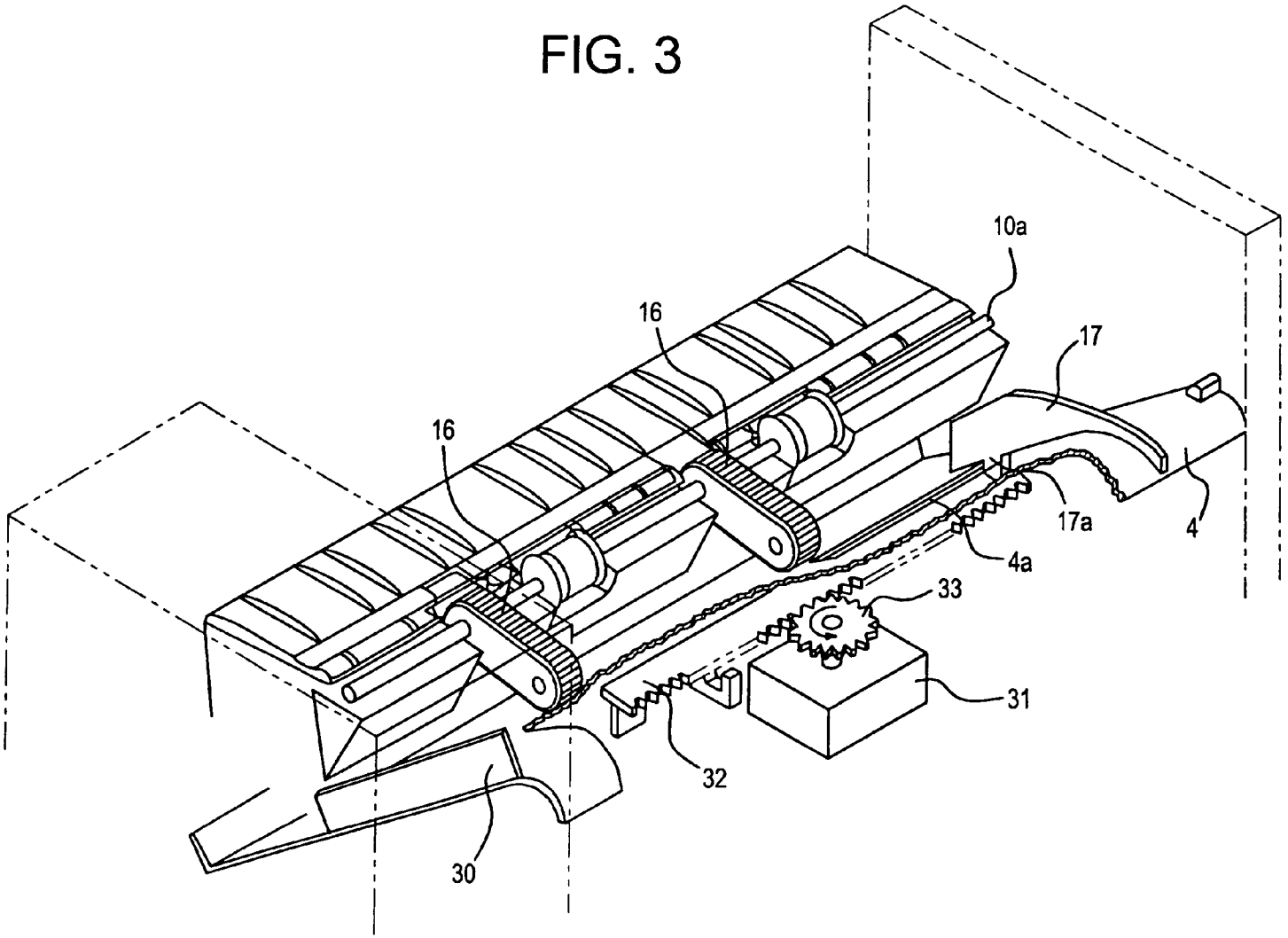
FIG. 3 is a perspective view of the part with the processing tray removed.
Figure 4:
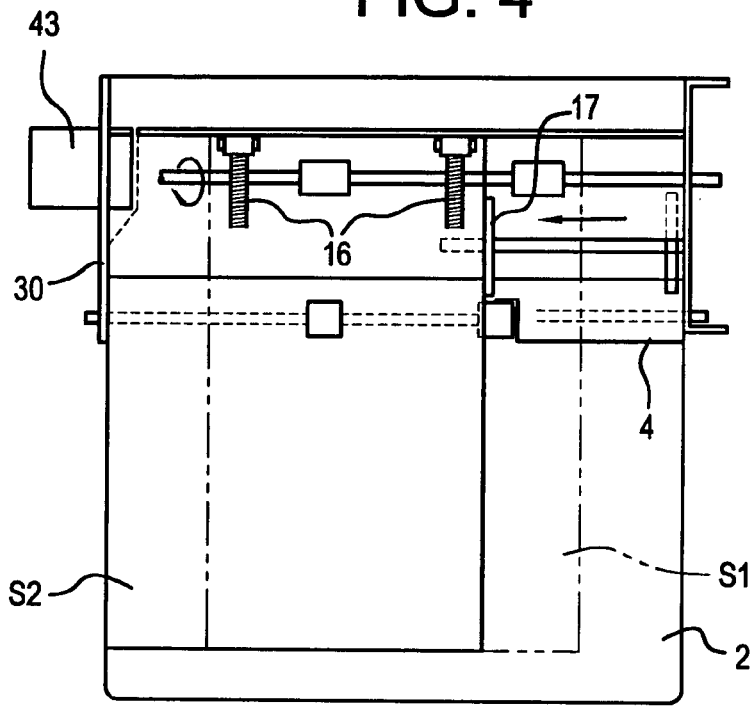
FIG. 4 is a plan view of the processing tray.
Figure 5:
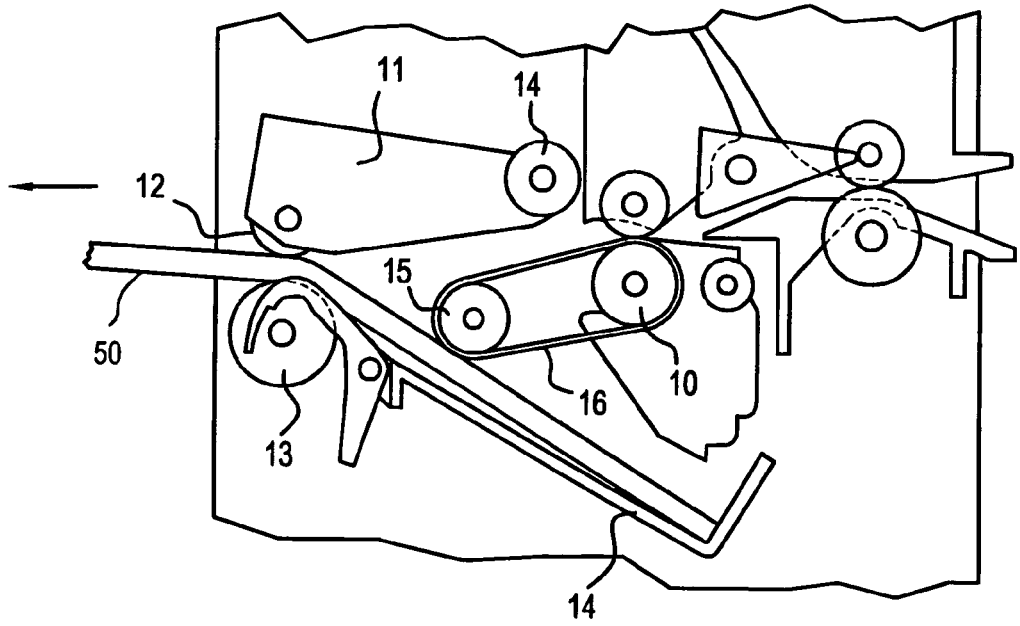
FIG. 5 is a sectional view of the part showing the status of the discharged set.
Figure 6:
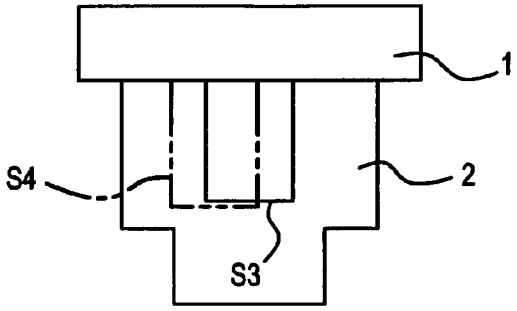
FIG. 6 is a plan view of the stacking tray.
Figure 8:
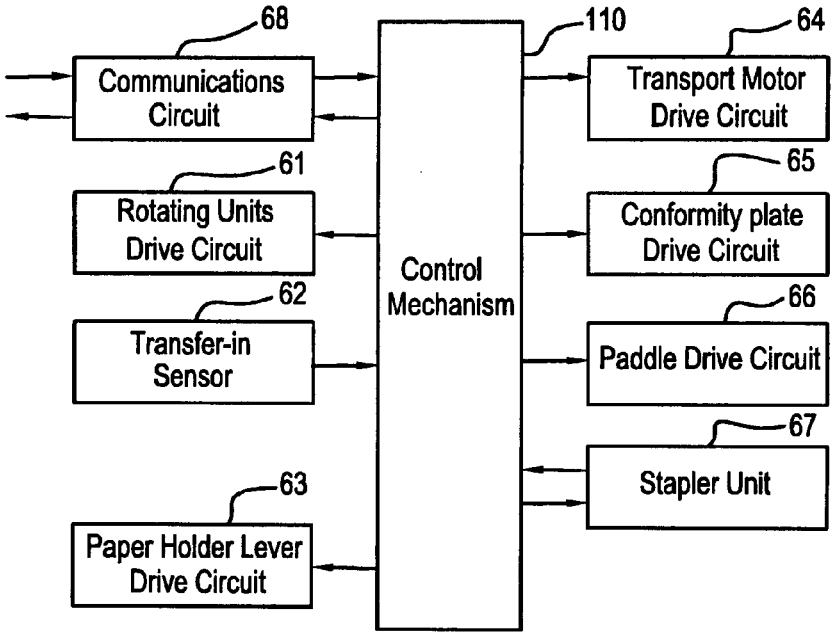
FIG. 8 is a drawing of the control mechanism circuit.
Figure 9:
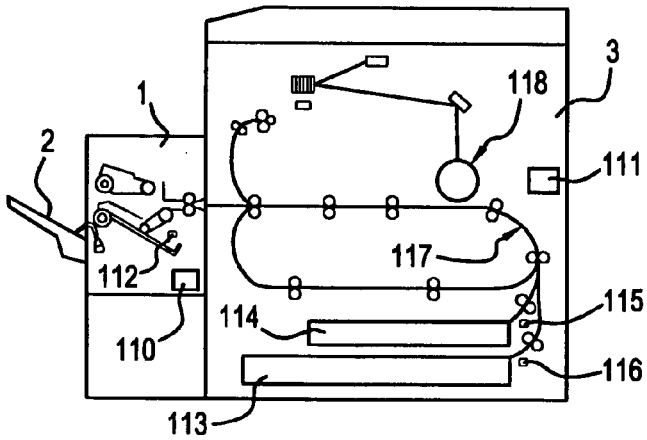
FIG. 9 is an explanatory drawing showing the entire apparatus.
Figure 7:
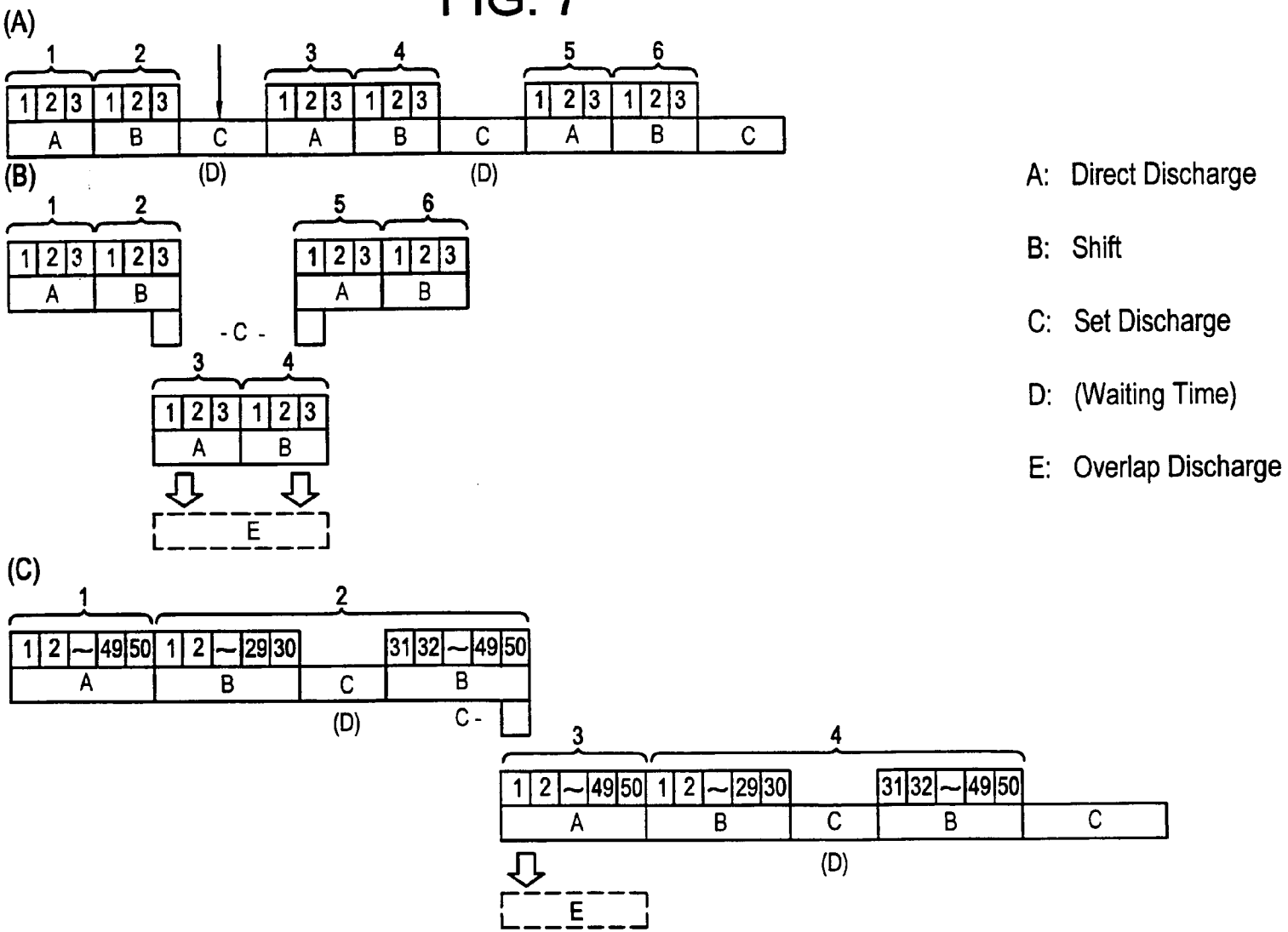
FIG. 7 is a drawing showing the sheet discharge pattern.

What is claimed is:

1. A sheet sorting apparatus comprising:

a stacking tray for stacking sheets formed with images;

a processing tray for temporarily stacking sheets in a process leading to the stacking tray;

a first path for discharging the sheets to the stacking tray without temporarily stacking the sheets on the processing tray;

a second path for discharging the sheets to the stacking tray after discharged sheets are temporarily stacked on the processing tray;

shifting means for shifting the sheets stacked on the processing tray to change a stacking position of the sheets stacked on the stacking tray via the first path and the sheets stacked on the stacking tray via the second path;

capacity recognition means for recognizing whether a stacking limit of the processing tray is exceeded by detecting a volume of the sheets temporarily stacked on the processing tray; and wherein an action for discharging from the first path directly to the stacking tray, and an action for shifting a sheet bundle and discharging from the second path to the stacking tray are performed according to each sorting sheet count information, when sheet sorting is specified;

means for discharging the sheets thus far temporarily stacked on the processing tray to the stacking tray, activating the shifting means so that the stacking of subsequent sheets is possible at the same stacking position on the stacking tray as the sheets just discharged from the processing tray until a predetermined number of sheets specified by sheet-sorting count information is reached, and discharging the subsequent temporarily stacked sheets from the processing tray when the predetermined number of sheets is reached, when the capacity recognition means recognizes that a stacking limit of the processing tray has been exceeded when temporarily stacking the sheets in the processing tray in the second path;

wherein a sheet bundle discharged from the processing tray when the sheet-sorting count is reached and at least a first sheet of sheets discharged from the first path are overlapped and discharged to the stacking tray.

2. The sheet sorting apparatus of claim 1, wherein the temporary stacking of the subsequent sheets onto the processing tray is stopped when the capacity recognition means recognizes the stacking limit of the processing tray has been exceeded.

3. The sheet sorting apparatus of claim 1, wherein the capacity recognition means comprises counting means for counting a number of the sheets stacked on processing tray.

4. The sheet sorting apparatus of claim 1, wherein the capacity recognition means comprises a level sensor to measure a height level of the sheets stacked on the processing tray.

5. A sheet sorting apparatus comprising:

a stacking tray for stacking sheets formed with images;

a processing tray for temporarily stacking sheets in a process leading to the stacking tray;

a first path for discharging the sheets to the stacking tray without temporarily stacking the sheets on the processing tray;

a second path for discharging the sheets to the stacking tray after discharged sheets are temporarily stacked on the processing tray;

shifting means for shifting the sheets temporarily stacked on the processing tray to sort sheet bundles by changing a stacking position of sheets stacked in the stacking tray via the first path and sheets stacked in the stacking tray via the second path;

capacity recognition means for recognizing whether a stacking limit of the processing tray is exceeded by detecting a volume of the sheets temporarily stacked on the processing tray;

control means for stopping the shifting action, discharging the shifted sheets from the processing tray t:o the stacking tray, then restarting the action of the shifting means so that the shift position is the same for the previous discharged sheets and the subsequent discharged sheets, and discharging subsequent stacked sheets when the sheets have reached a number of sheets specified by sheet-sorting count information then discharges sheets stacked in the processing tray from the processing tray to the stacking tray, when the capacity recognition means recognizes that a stacking limit of the processing tray has been exceeded when stacking the sheets in the processing tray;

wherein a sheet bundle discharged from the processing tray via the second path when a number of sheets specified by sheet-sorting count information is reached and at least a first sheet of a sheet group discharged from the first path to sort from these sheets are overlapped for discharge to the stacking tray.

* * * * *